United States Patent [19]

Suzuki

[11] 4,245,374

[45] Jan. 20, 1981

[54] CONNECTOR

[75] Inventor: Tadashi Suzuki, Saitama, Japan

[73] Assignee: Satogosei Co., Ltd., Tokyo, Japan

[21] Appl. No.: 87,573

[22] Filed: Oct. 23, 1979

[30] Foreign Application Priority Data

Apr. 13, 1979 [JP] Japan ..... 54-45118

[51] Int. Cl.[3] ..... B65D 55/06; B65D 63/00

[52] U.S. Cl. ..... 24/16 PB; 24/17 AP; 24/150 FP; 24/206 A; 292/321

[58] Field of Search ..... 24/16 PB, 17 AP, 30.5 P, 24/206 A, 150 FP; 292/318, 319, 321, 322, 320

[56] References Cited

U.S. PATENT DOCUMENTS

| | | | |
|---|---|---|---|
| Re. 27,357 | 5/1972 | Merser | 24/150 FP |
| Re. 27,391 | 6/1972 | Merser | 24/150 FP |
| 3,516,124 | 6/1970 | Merser | 24/16 PB |
| 3,590,442 | 7/1971 | Geisinger | 24/16 PB |
| 3,712,655 | 1/1973 | Fuehrer | 292/322 |
| 3,816,879 | 6/1974 | Merser et al. | 24/206 A |
| 3,973,299 | 8/1976 | Keefe | 24/150 FP |
| 4,038,725 | 8/1977 | Keefe | 24/150 FP |
| 4,059,300 | 11/1977 | Moberg et al. | 292/322 |
| 4,093,288 | 6/1978 | Suzuki | 292/321 |
| 4,135,749 | 1/1979 | Caveney et al. | 24/16 PB |

FOREIGN PATENT DOCUMENTS

| | | | |
|---|---|---|---|
| 2901061 | 8/1979 | Fed. Rep. of Germany | 24/16 PB |
| 46-11373 | 3/1971 | Japan . | |
| 47-39739 | 12/1972 | Japan . | |
| 50-4947 | 2/1975 | Japan . | |
| 51-6373 | 2/1976 | Japan . | |
| 51-117268 | 10/1976 | Japan . | |

*Primary Examiner*—Victor N. Sakran

*Attorney, Agent, or Firm*—Mason, Fenwick & Lawrence

[57] ABSTRACT

A connector formed of flexible plastic has a female socket at one end of an elongated flexible connection rod provided with two pivotal lock lugs positioned to face each other within a locking aperture and a male inserting head and a stopper at its opposite end which are inserted in the locking aperture; a flexible flange on the male inserting head engages the pivotal lock lugs during insertion and cannot be withdrawn following insertion; a bulbous stopper limits inward movement of the components in the female socket.

7 Claims, 7 Drawing Figures

CONNECTOR

BACKGROUND OF THE INVENTION

This invention relates to loop type connectors to be used to securely connect articles such as the shoes of a pair with each other and with a price tag or the like.

Connectors formed of synthetic resin for connecting articles with each other have previously been integrally molded in large quantities and have been extensively used in place of string or cord connectors. Examples of such prior art devices are disclosed in Japanese Patent Publication No. 11373/1971, Japanese Patent Laid Open No. 117268/1976 and Japanese Utility Model Publications Nos. 39739/1972, 4947/1975 and 6373/1976.

Prior known connector devices comprise a first type which can be unlocked after being locked and a second type which cannot be unlocked after being locked. The second type of connector cannot be unlocked unless the connector is broken and destroyed and is therefore utilized for various uses that dictate the essential need of non-separation or articles from each other or from price tags or identifying tags.

It is necessary that such connectors can be positively and easily locked without being disconnected after being locked; moreover, such articles must be easy to lock without requiring any excessive force or dexterity.

However, the conventional connectors have not always been satisfactory with respect to the need for locking ease and workability.

Thus, it is the primary object of this invention to provide a new and improved plastic connector.

SUMMARY OF THE INVENTION

According to the preferred embodiment of the present invention, there is provided a connector which consists of a flexible rod-like connecting member having at one end a socket aperture provided with opposed pivotal locking lugs and at the other end a male inserting head which, when inserted in the socket aperture, engages the pivotal lugs and cannot be removed.

Therefore, an achieved object of the present invention is the provision of a connector which cannot be unlocked after being locked.

Another achieved object of the present invention is the provision of a connector which can be easily connected without the need for great manual dexterity or the application of substantial force.

BRIEF DESCRIPTION OF THE DRAWINGS

The foregoing objects and aspects of the invention will become apparent from the following description with reference to the accompanying drawings which show the preferred embodiment of the present invention and in which.

Figure 1:
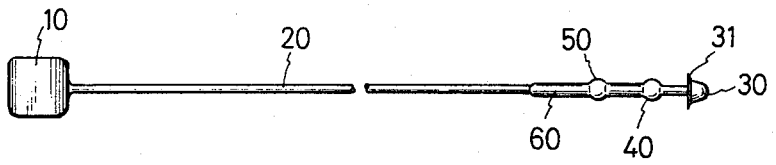
FIG. 1 is an elevation of the preferred embodiment with a portion removed.
Figure 2A:
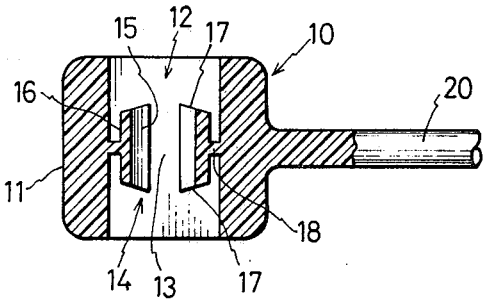
FIG. 2A is a magnified vertically sectioned view of end means providing a locking socket aperture of the preferred embodiment.
Figure 2B:
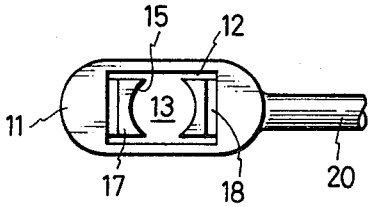
FIG. 2B is a plan view of the locking socket aperture.
Figure 3:
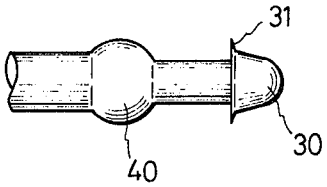
FIG. 3 is a magnified view of a male locking head on an opposite end of the preferred embodiment.

The preferred embodiment of the present invention comprises a flexible rod-like connecting member 20 having a female connector head 10 at one end which includes a socket aperture 14 in which two opposed pivotal locking lugs 16 are mounted on opposed sides by means of flexible pillars 18 as shown in FIG. 2A. Socket aperture 14 has open ends 12 with an axial passageway 13 extending between the opposed cylindrical curved faces 15 of the pivotal locking lugs 16. It should be observed that the pivotal locking lugs 16 are equidistantly spaced from the side walls of the socket aperture 14 and the axis of the socket aperture 14 as will be evident from inspection of FIGS. 2A and 2B. The ends 17 of the pivotal locking lugs are canted with respect to the axis of passage 13.

Figure 4:
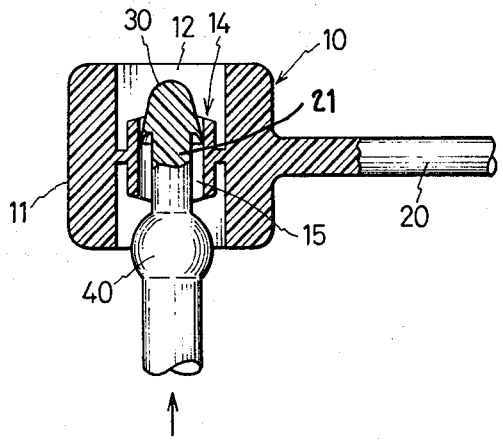
FIG. 4 is an expanatory bisecting sectional view of the locking socket aperture showing the male locking head in an intermediate position during insertion.

The end of the flexible rod-like connector 20 opposite the female head 10 is provided with male connector means which is insertable into the female head 10 but cannot be withdrawn therefrom. More specifically, a male locking head 30 has a radial rim flange 31 and can be inserted through the axial passageway 13 between the pivotal locking lugs 16 as shown in FIG. 4. A bulbous stopper 40 is rearwardly spaced on a thin relatively small diameter rod 21 from the male locking head 30. Rod 21 is of approximately the same length as lugs 16. Stopper 40 has a spherical surface with a diameter that is greater than the width of the space between inwardly facing cylindrical surfaces 15 of the pivotal lugs 16.

It is of substantial importance that the ends 17 of the pivotal lugs 16 are canted so that their inner extent is closer to the end of opening 12 than is their rear surface as will be apparent from inspection of FIG. 2A. It should also be noted that the flexible pillars 18 are of the same width as the pivotal lugs 16 so that the pivotal lugs cannot twist within the opening 12 with their movement being limited to pivotal movement about an axis extending through the flexible pillar 18 in a direction perpendicular to the drawing in FIGS. 4, 5 and 6.

A pusher protrusion grip 50 is spaced from the stopper 40 a sufficient distance and is of sufficient size to be easily gripped by the user for forcing the male inserting and locking head 30 upwardly through the axial passageway 13 in the direction of the arrow in FIG. 4. It will be observed that a large relatively thick connector portion 60 extends between the pusher protrusion grip 50 and the bulbous stopper 40 so as to provide sufficient rigidity for permitting the parts to be interconnected by the pushing movement which must force the male inserting and locking head 30 upwardly through the passageway 13 until it reaches the position of FIG. 5. The radial rim flange 31 on the locking head is of greater diameter than the width of passage 13 so that any withdrawal movement of means 50, 60, 40, 30 will result in engagement of the lower face of the radial rim flange with the uppermost ends of the canted surfaces 17 of the pivotal lugs 16 to pivot the lugs to the position of FIG. 6 to prevent removal of the locking head from within the female head member 10. Moreover, inward (upward in FIG. 5) pushing movement of the stopper 40 will pivot the lugs 16 in the same direction as they are pivoted by outward movement of male locking head 30. The diameter of member 40 is of sufficient size as to prevent it from passing through the axial passageway 13. The shape of member 40 is such that it engages the surface of the pivotal lug members so that the lug members are consequently pivoted to the same position illustrated in FIG. 6 when member 40 is pushed upwardly.

Another significant aspect of the invention resides in the symmetrical nature of the female locking head which permits the male locking member 30 to be inserted from either direction into the socket opening 12.

It has been found that good results are achieved when the diameter of the inserting space 13 is 1.5 millimeters, the diameter of the outer edge radial rim flange 31 is 1.6 millimeters and the diameter of the spherical end head of the male locking member 30 is 1.45 millimeters. Since the diameter of the head 30 is smaller than the diameter of space 13 and the protrusion 31 is of flexible nature, the parts can be easily inserted through the opening 13 as demonstrated in FIG. 4.

Figure 5:
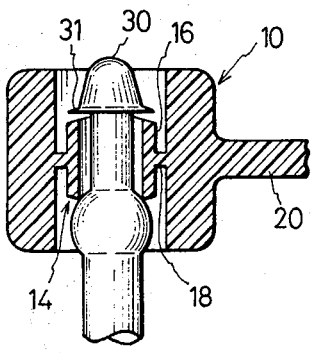
FIG. 5 is similar to FIG. 4 but shows the parts in position following insertion.
Figure 6:
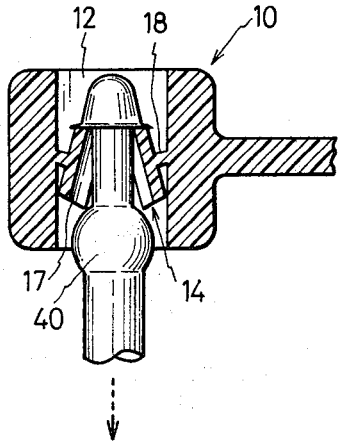
FIG. 6 is an explanatory view showing the positions assumed by the parts upon attempted removal of the male locking head.

The bulbous stopper member 40 is spaced from the lower surface of radial rim flange 31 by a distance approximately the same as the height of the pivotal locking lugs so that there is a minimum amount of free play of the parts once they have been inserted to the position of FIG. 5. When the stopper is moved upwardly beyond the position of FIG. 5, it engages the pivotal lugs to pivot the end which it engages outwardly to the open position of FIG. 6 in the same manner as is resultant from attempted removal of the locking means in the direction of the dotted arrow of FIG. 6. Thus, the parts are held in the position of FIG. 5 and the elements 30, 40 etc. cannot be moved upwardly or downwardly through the space 13. In some instances, it may be desirable to make the connecting portion of the device between the elements 40 and 30 relatively thin so that it can be broken in the event it is desired to disconnect the components.

The entire connector device of the present invention can be manufactured by integral molding of synthetic resin, such as polyethelene or other suitable plastic, so as to be easily mass produced at a minimum of expense. Moreover, the device is extremely easy to use and provides a reliable juncture which cannot be disconnected without destroying the connector.

While the preferred embodiment of the invention has been described, it should be understood that the numerous variations thereof will occur to those of skill in the art and the spirit and scope of the invention is to be limited solely by the appended claims.

I claim:

1. A connector consisting of a flexible rod-like connecting member having at one end a female connector head provided with opposed elongated pivotal locking lugs within a socket aperture, a male locking head on the opposite end of the flexible rod-like connector having a flexible radial flange adjacent an inner end and a bulbous stopper spaced from said male locking head a distance greater than the length of said male locking lugs wherein said opposed pivotal locking lugs are connected and held respectively in the middle portions of the wall surfaces of the socket aperture so as to be positioned in the center of the socket aperture and including an inserting space for the male locking head formed between opposed facing cylindrical surfaces of the male locking lugs spaced so that the male locking lug can be inserted to a locking position past the elongated pivotal locking lugs which remain parallel during such insertion, said flexible radial flange being dimensioned to engage the pivotal locking lugs when in the locking position in response to reverse movement of the connecting member to pivot the locking lugs beneath the flexible radial flange member to preclude further outward movement of the male locking head and a bulbous stopper of greater diameter than that of the inserting space separated from said male locking head by a relatively small diameter rod portion of the connecting member of a length approximately equal the length of said elongated pivotal locking lugs.

2. A connector according to claim 1 wherein said socket aperture is of rectangular shape and the opposed pivotal locking lugs are connected to end walls of said socket aperture by flexible pillar members extending in cantilever manner from said end walls.

3. A connector according to claim 2 wherein opposite ends of said pivotal locking lugs are canted so that their inner extent away from the said walls is closer to the end of the nearest socket aperture than is their outer extent adjacent said end walls.

4. A connector according to claim 3 wherein said male locking head is a cone having a spherical top with the diameter of the bottom surface of the male locking head being smaller than the diameter of the inserting space and the diameter of the flexible radial flange is larger than that of the inserting space.

5. A connector according to claim 4 wherein said bulbous stopper has a size and shape which causes the opposed pivotal locking lugs to pivot against the rod portion when the bulbous stopper is moved inwardly against the pivotal locking lugs to preclude further inward movement of the bulbous stopper.

6. A connector according to claim 1 wherein said bulbous stopper has a size and shape which causes the opposed pivotal locking lugs to pivot against the rod portion when the bulbous stopper is moved inwardly against the pivotal locking lugs to preclude further inward movement of the bulbous stopper.

7. A connector according to claim 6 wherein said male locking head is a cone having a spherical top with the diameter of the bottom surface of the male locking head being smaller than the diameter of the inserting space and the diameter of the flexible radial flange is larger than that of the inserting space.

* * * * *